United States Patent [19]

Carmody

[11] Patent Number: 4,503,913

[45] Date of Patent: Mar. 12, 1985

[54] SUBSURFACE WELL SAFETY VALVE

[75] Inventor: Michael A. Carmody, Broken Arrow, Okla.

[73] Assignee: Baker Oil Tools, Inc., Orange, Calif.

[21] Appl. No.: 514,653

[22] Filed: Jul. 18, 1983

[51] Int. Cl.[3] ..... E21B 34/10

[52] U.S. Cl. ..... 166/319; 166/321; 166/332

[58] Field of Search ..... 166/319–324, 166/316, 325, 332, 334, 72; 251/62; 91/196

[56] References Cited

U.S. PATENT DOCUMENTS

| | | | |
|---|---|---|---|
| 2,598,203 | 5/1952 | Acker, Jr. | 91/196 |
| 2,780,290 | 2/1957 | Natho | 166/319 |
| 3,065,949 | 11/1962 | De Frees | 251/62 |
| 4,005,751 | 2/1977 | Page, Jr. | 166/321 |
| 4,049,052 | 9/1977 | Arendt | 166/321 |
| 4,119,146 | 10/1978 | Taylor | 166/72 |
| 4,161,219 | 7/1979 | Pringle | 166/324 |
| 4,215,748 | 8/1980 | Pace et al. | 166/322 |
| 4,252,197 | 2/1981 | Pringle | 166/72 |
| 4,273,194 | 6/1981 | Pringle et al. | 166/323 |
| 4,335,733 | 6/1982 | Richards | 251/62 |

*Primary Examiner*—James A. Leppink
*Assistant Examiner*—Hoang C. Dang
*Attorney, Agent, or Firm*—Norvell & Associates

[57] ABSTRACT

A subsurface control fluid pressure actuated well safety valve employs one or more spindles attached to the valve housing and spindle sleeves attached to a shiftable actuating flow tube. The spindles and spindle sleeves are positioned between the valve housing and the flow tube and a change in the pressure force acting on the spindle and on the spindle sleeve will result in relative movement of the spindle sleeve with respect to the spindle to cause the flow tube actuator to shift and open a fluid transmission conduit.

8 Claims, 5 Drawing Figures

SUBSURFACE WELL SAFETY VALVE

BACKGROUND OF THE INVENTION

1. FIELD OF THE INVENTION:

This invention relates to safety valves used in subterranean wells, such as oil or gas wells, and specifically to valves which are actuated in response to changes in control fluid pressure in a separate control line extending from the subsurface valve location to the well surface.

2. DESCRIPTION OF THE PRIOR ART:

Subsurface safety valves are commonly used in oil or gas wells to prevent the escape of fluids from a producing formation in the event of damage at the well surface. Typically, these valves are incorporated into or attached to the fluid transmission production tubing which is inserted through the well casing and extends from the surface of the well to the producing formation. The flow of fluids through this inner tubing string must be interrupted in the event of damage to the wellhead at the surface. By positioning these valves at a location below the well surface, for example below the mud line in an offshore well, the valve can be closed to prevent the escape of produced fluids. The most common subsurface safety valves employ either a shiftable flapper or a rotatable ball valve head to open and close the fluid transmission conduit. Commonly, either a shiftable flapper or ball valve head is actuated in response to axial movement by a flow tube actuator. In conventional ball valves, downward movement of a flow tube actuator will impart rotation to a closed ball valve head to rotate a central passage through the ball into alignment with the fluid transmission conduit. In conventional flapper valves, the flow tube will engage a closed flapper to shift the flapper to the open position by rotation about the flapper hinge.

In these conventional valves, axial movement of the flow tube actuator is normally imparted by an increase in control fluid pressure. Hydraulic control fluid is generally stored in an external control line extending from the valve to the well surface. An increase in pressure can be initiated at the well surface and this increase in pressure is transmitted through the hydraulic control fluid to the valve. Conventionally, unbalanced surfaces on the flow tube actuator are exposed to control pressure and an increase in control pressure will result in an increase in the control force acting on the flow tube. Eventually, a sufficient pressure force will be created to urge the flow tube actuator downwardly relative to the closed flapper or ball valve head and against the action of the well pressure and any spring which might be used to hold the flow tube and the valve head in the closed position. When control fluid pressure is reduced or removed, be it intentionally or as a result of damage to the external control line, the well pressure and spring acting on the flow tube actuator will be sufficient to shift this actuator upwardly permitting the valve head to close.

In addition to these conventionally actuated valves, some subsurface safety valves employ shiftable spools, pistons, or pilot valve members for actuating a flow tube actuator. These separate shiftable spools, pistons, or pilot valves may be employed to reduce the surface area upon which hydraulic fluid acts. A reduction in surface area means that the hydraulic pressure force acting to actuate the valve is less, thus permitting the safety valve to be positioned at greater depths. U.S. Pat. No. 4,005,751, U.S. Pat. No. 4,119,146 and U.S. Pat. No. 4,161,219 each disclose subsurface safety valves having a spool, piston, or pilot valve mounted in the valve housing or in a sidepocket mandrel.

SUMMARY OF THE INVENTION

A subsurface well safety valve for use in controlling the flow in a fluid transmission conduit, such as a tubing string in a subterranean well, is actuated by changes in control fluid pressure. The valve comprises an outer valve housing with a rotatable or shiftable valve closure member attached thereto. In the preferred embodiment of the invention, a flapper valve is shiftably attached to the valve housing, but other conventional conduit closure members, such as a ball valve head, can be attached thereto. An axially shiftable flow tube actuator is movable relative to both the valve housing and the valve closure member. An increase in control fluid pressure will result in downward movement of the flow tube actuator and, in the preferred embodiment of this invention, the flow tube will engage the upper surface of the flapper valve head to rotate the flapper to the open position. One or more axially extending spindles having a flow path extending completely therethrough can be fixed to the valve housing with the spindle flow path communicating with the control fluid in the external control line. An axially shiftable tubular sleeve is positioned around the spindle and engages extending abutting surfaces on the exterior of the flow tube actuator. The spindles and the spindle sleeves are each received between the flow tube actuator and the vave housing and sealing integrity is established between the spindle and the inner bore of the spindle sleeve. An increase in fluid pressure within the spindle sleeve will cause downward movement of the spindle sleeve and the attached flow tube actuator to open the valve closure member. The spindle and spindle sleeve assembly is suitable for use on hydraulically actuated tools other than subsurface safety valves comprising the preferred embodiment disclosed herein. Separate axially extending straightening rods can also be attached to the valve housing and received within supporting sleeves also attached to the flow tube actuator. By disposing the straightening rods and/or spindles circumferentially between the valve housing and the flow tube actuator, rotation of the flow tube actuator relative to the valve housing during movement of the valve actuator is prevented.

DETAILED DESCRIPTION OF THE PREFERRED EMBODIMENT

Figure 1A:
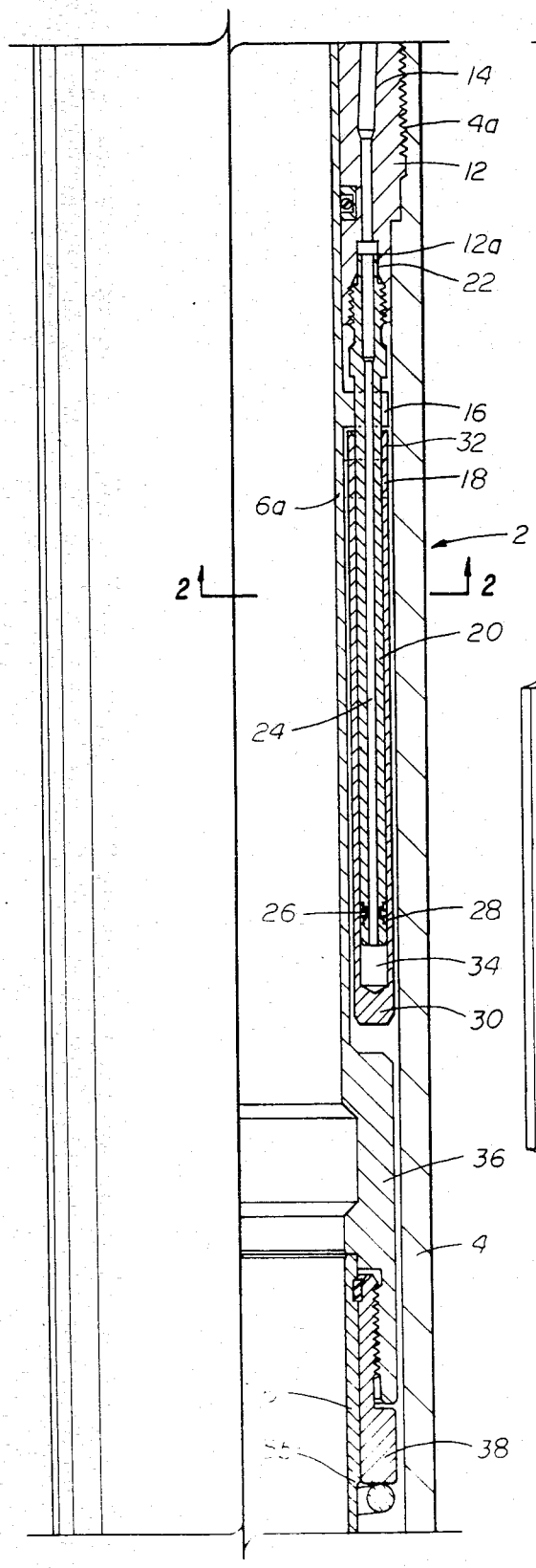
FIGS. 1A and 1B are longitudinal continuations of a subsurface well safety valve in the closed position.

The principle structural components of the pressure actuated subsurface safety valve are the outer valve housing 4, flow tube actuator 6, a spring 8 and a valve closure member 10. An axially extending spindle 20 and a surrounding sleeve 30 are attached respectively to the housing 4 and the flow tube 6.

Figure 1B:
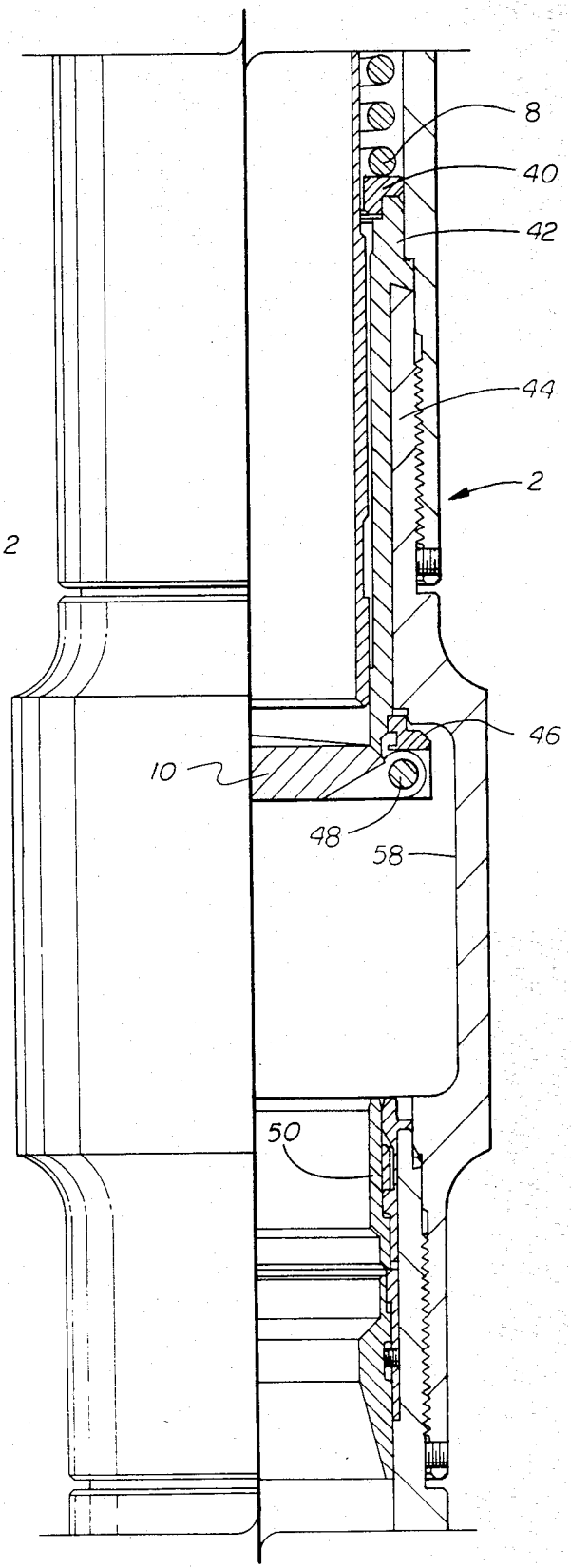

Conventional subsurface safety valves and valves, such as safety valve 2 shown in FIGS. 1A and 1B, can be employed in a tubing mounted or in a wirelne mounted configuration. In the tubing mounted configuration, the safety valve is incorporated directly into the production tubing string. In a wireline version, the valve can be suspended from a lock secured in a nipple contained in the subsurface tubing string. The essential elements of the valve depicted herein could be incorporated into either a tubing mounted version or a wireless version. In either case, means would be provided at the top of the valve (not shown) for securing the valve at the desired location within the well.

A ported sub which can be attached to an external control line by conventional means (not shown) is attached at the upper end of outer valve housing 4 by means of conventional threaded connection 4*a*. Ported sub 12 has an internal axially extending flow path 14 communicating with the external control line. An axially extending spindle 20 is attached to ported sub 12 again by means of a threaded connection 12*a*. Spindle 20 comprises a cylindrical tubular member having an axis offset and parallel to the internal bore axis of safety valve 2. A plurality of similar spindles may be attached at various circumferential locations around the inner periphery of the valve housing 4. Each spindle 20 is positioned between the outer valve housing 4 and the inner flow tube actuator 6.

Figure 2:
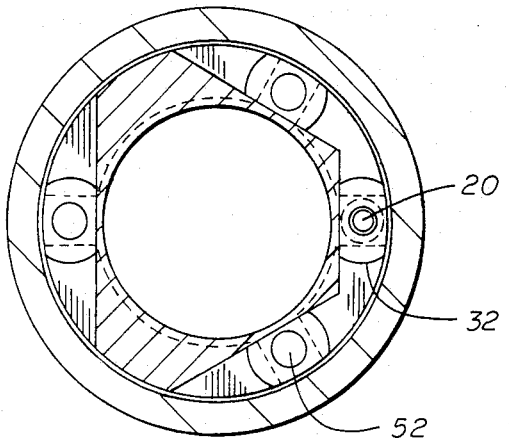
FIG. 2 is a section view taken along section 2—2.
Figure 3:
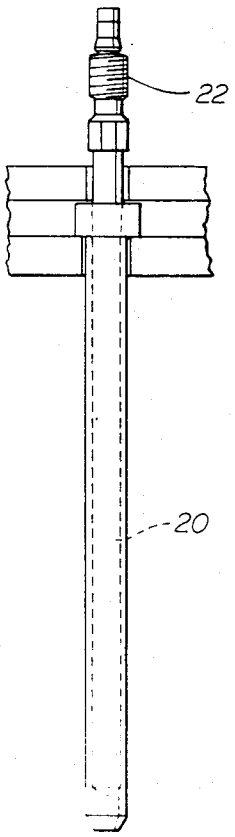
FIG. 3 is a view showing the pressure actuation mechanism attached to the flow tube actuator.

As can be seen in FIG. 2, only a single spindle 20 is employed in the preferred embodiment of this valve. Spindle 20 has a central flow path or bore 24 extending completely therethrough. The threaded connection 12*a* between ported sub 12 and spindle 20 establishes a metal-to-metal sealing integrity with axially extending port 14 communicating with spindle flow path or bore 24. Flow path 24 extends through the spindle and opens on the lower end of spindle 20. Adjacent the lower end of the spindle, a circumferential groove 26 extends completely around the outer periphery of spindle 20. An elastomeric seal, generally having a T-shape configuration, is positioned within groove 26 and extends completely around the spindle periphery. A cylindrical or tubular sleeve extends concentrically around spindle 20. In the closed position of FIG. 1, the sleeve 30 receives the greater portion of the length of spindle 20 in the bore of sleeve 30. The inner surfaces defining the bore of sleeve 30 comprise a generally honed or smooth finish and seal 28 establishes sealing integrity with this surface. As seen in FIG. 1A, when the valve is in the closed position, the lower end of spindle 20 is spaced from the lower end of the internal bore of sleeve 30 to define a pressure actuating cavity 34 therebetween. Cavity 34 communicates through flow path 24 with the external control line and seals 28 completely enclose cavity 34.

Spindle 30 has an enlarged sleeve shoulder 32 at its upper end. This enlarged sleeve shoulder is dimensioned to be received within the annulus between valve housing 4 and flow tube actuator 6. The circumferential ends of shoulder 32 are, however, enlarged. These enlarged sleeve shoulders 32 are dimensioned for receipt within two axially spaced abutment rings 16 and 18, each forming an integral part of the upper flow tube actuator section 6*a*. Each sleeve 30 can be slidably attached to upper flow tube actuator section 6*a* by inserting shoulder 32 radially between the axially spaced abutment ring 16 and 18. When sleeves 32 are attached at one or more circumferential locations on the exterior of flow tube actuator section 6*a*, the flow tube assembly 6*a*, including one or more sleeves 30, can be inserted as a subassembly into the bore of valve housing 4.

Figure 4:
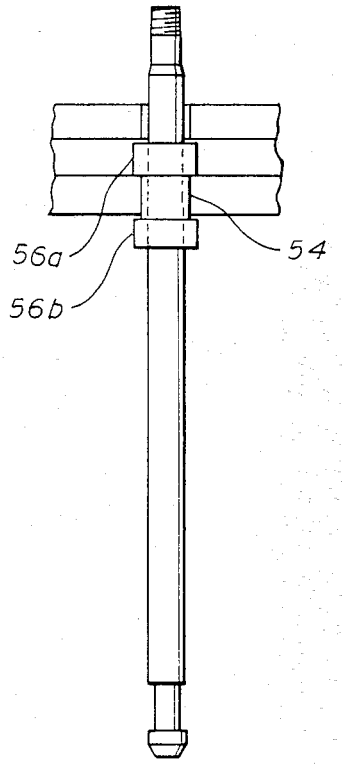
FIG. 4 is a view of the flow tube actuator centering mechanism.

In the preferred embodiment of this invention, only one spindle 20 and sleeve 30 are employed to comprise the pressure actuating mechanism of the valve (see FIG. 2). In this preferred embodiment, however, the three axially extending rods 52 are attached to the valve housing 4 by conventional threaded connections in much the same manner as spindle 20. These three straightening rods 52 are shown in FIG. 2 and in this preferred embodiment these three rods are positioned at 120° spacing around the periphery of the actuating flow tube 6 and within the bore of valve housing 4. A support rod sleeve 54 having upper and lower shoulders 56 can be attached to the outer surface of the outer surface of the upper flow tube actuator 6*a* in the same manner as sleeve 30 (see FIG. 4). Upper and lower abutment rings 16 and 18 receive the support rod shoulders 56*a* and 56*b* as shown in FIG. 4. Support rod sleeve 54 has a bore extending therethrough for receiving support rod 52. Both the spindle sleeve 30 and the support rod sleeves 54 are free to slide relative to the tubular spindles or support rods received therein. Thus spindle 20 and support rod 52 are fixed relative to the valve housing while sleeves 30 and 54 are attached to the flow tube actuator 6. Movement of flow tube actuator 6 relative to valve housing 4 is accompanied by movement of sleeves 30 and 54 relative to spindle 20 and support rods 52.

Upper flow tube actuator section 6*a* is attached by means of a conventional threaded connection to an upper spring retainer 38 below the position of spindle 20. A lower flow tube actuator section is then secured on the interior of the spring retainer 38 and to the upper flow tube section 6*b*. A conventional helical spring 8 abuts the lower surface of spring retainer 38 and is positioned within a spring retaining cavity between lower flow tube section 6*b* and valve housing 4. The majority of the length of the helical spring 8 has been omitted from FIGS. 1A and 1B. A second or lower spring retainer 42 is located between the valve housing and lower flow tube actuator section 6*b* at the lower end of spring 8. Spring retainer 40 abuts axially extending valve seat 42 which is in turn positioned between the valve housing 4 and the flapper housing 44. A valve base 46 is positioned within flapper valve housing 44 and the rotatable flapper 10 is carried on a pin 48 which is in turn carried by valve base 46. In the closed position, the lower end of flow tube actuator 6 is spaced from the upper surface of flapper 10 as shown in FIG. 1B. Downward movement of flow tube actuator 6 will result in engagement with the upper surface of flapper 10 and will impart rotation to the flapper moving flapper 10 from the closed position shown in FIG. 1B to the fully open position in which the flapper 10 would be received within recess 58 located above the lower valve base housing 50.

Axial movement of flow tube actuator 6 in the closed position of FIGS. 1A and 1B to the open position is imparted by means of an increase in fluid pressure in the external control line. Increased fluid pressure in the external control line will act through axially extending port 14 and spindle flow path 24 to cause the pressure within cavity 34 to increase. As the pressure in cavity 34 increases, the resultant pressure force acting upon spindle sleeve 30 and flow tube actuator 6 will eventually be greater than the well pressure forces acting in the opposite direction. Downward movement of spindle sleeve 30 relative to stationary spindle 20 will be transmitted through shoulder 32 and 18 to the valve actuator 6 resulting in eventual movement of the flow tube actuator and opening the flapper valve head 10. During movement of flow tube actuator 6 relative to valve housing 4, spindle 20 and support rods 52 will combine to prevent any rotation of the flow tube actuator 6 relative to the valve housing 4. Pressure actuation of flow tube 6 is thus established without the necessity of establishing any seals on the flow tube actuator itself. The only seal which is established in this pressure actuating mechanism is the seal between spindle 20 and spindle sleeve 30 by means of elastomeric seal 28. When the pressure in the external control line and in expanded cavity 34 is reduced, the well pressure and spring 8 combine to urge flow tube actuator 6 and spindle sleeve 30 in the upward direction eventually permitting flapper 10 to close the fluid transmission conduit extending through safety valve 2.

Although not shown in FIGS. 1A and 1B, it should be understood that flow port 14 can communicate with a circumferentially extending passageway above the interconnection between the ported sub 12 and spindle 20. By providing additional tapped holes communicating with this circumferentially extending path, provision can be made for adding one or more spindles. The surface area subjected to control fluid pressure and acting to shift the flow tube 6 can then be adjusted by the addition or subtraction of spindle and spindle sleeve assemblies. The relative diameters of the spindle and spindle sleeves can also be adjusted to further increase or decrease the pressure areas acting on the flow tube. This adjustment can be accomplished without changing any of the remaining components of the valve. Identically sized housings and flow tubes can be used while relatively fine adjustments can be made to the spindle and spindle sleeves to size the actuation forces for the valve to fit specific situations. The tapped holes communicating with the cylindrical flow path and with control fluid pressure can simply be closed by the insertion of a straightening rod to seal this tapped hole.

Although the invention has been described in terms of the specified embodiment which is set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A hydraulically actuable well tool for use in a subterranean well, comprising:

a housing having a bore therethrough;

a tubular member axially shiftable in the bore of the housing relative to the housing;

a spindle attached to the housing and extending axially between the housing and the tubular member in the bore of the housing;

a sleeve disposed concentrically around the spindle and axially shiftable relative thereto, and defining an enclosed cavity at one closed end of the sleeve;

seal means adjacent the enclosed end for establishing sealing integrity between the spindle and the sleeve;

means for attaching said sleeve to said tubular member; and control fluid actuating means including a path extending through the spindle and into the enclosed cavity between the seal means and the one end of the sleeve relative to said spindle, axial movement of the sleeve being transmitted to the tubular member to move the tubular member relative to the housing.

2. A valve for controlling the flow in a fluid transmission conduit in a subterranean well, comprising:

a valve housing;

a valve closure member shiftable between open and closed positions;

a tubular valve actuator disposable concentrically within the housing and communicating with the fluid transmission conduit when the valve closure member is open; axially shiftable relative to the housing and having means for opening and closing the valve closure member upon axial movement relative to the housing;

a spindle attached to the housing and extending axially between the housing and the valve actuator;

a sleeve disposed concentrically around the spindle and axially shiftable relative thereto, and defining an enclosed cavity at one end of the sleeve;

seal means for establishing sealing integrity between the spindle and the sleeve;

means for attaching said sleeve to said valve actuator; and control fluid actuating means including a path extending through the spindle and into the enclosed cavity between the end of the spindle and the one end of the sleeve, whereby a change in control fluid pressure shifts said sleeve relative to the spindle, axial movement of the sleeve being transmitted to the actuator for shifting the valve closure member.

3. A valve for controlling the flow in a fluid transmission conduit in a subterranean well, comprising:

a valve housing;

a valve closure member shiftable between open and closed positions;

a tubular valve actuator disposable concentrically within the housing and communicating with the fluid transmission conduit when the valve closure member is open; axially shiftable relative to the housing and having means for opening and closing the valve closure member upon axial movement relative to the housing;

a spindle attached to the housing and extending axially between the housing and the valve actuator;

a sleeve disposed concentrically around the spindle and axially shiftable relative thereto, and defining an enclosed cavity at one end of the sleeve;

seal means for establishing sealing integrity between the spindle and the sleeve;

means for attaching said sleeve to said valve actuator; and control fluid actuating means including a path extending through the spindle and into the enclosed cavity between the seal means and the one end of the sleeve, whereby a change in control fluid pressure shifts said sleeve relative to the spindle, axial movement of the sleeve being transmitted to the actuator for shifting the valve closure member.

4. The valve of claim 3 wherein the sleeves comprise cylindrical members having shoulder means thereon for attachment to the tubular valve actuator upon radial insertion thereof, the assembly comprising the tubular valve actuator being insertable into a cylindrical housing bore.

5. A valve for controlling the flow in a fluid transmission conduit in a subterranean well, comprising:

a valve housing;

a valve closure member shiftable between open and closed positions;

a valve actuator axially shiftable relative to the housing and having means for opening and closing the valve closure member upon axial movement relative to the housing;

a plurality of circumferentially spaced spindles attached to the housing and extending axially between the housing and the valve actuator;

sleeve means disposed around each spindle and attached to the valve actuator, the sleeve means being axially slidable relative spindles, the valve actuator being restrained by the spindles and sleeve means against rotation during axial movement of the sleeves and the valve actuator; and an enclosed cavity defined by the end of one of the sleeve means disposed on one of the spindles, the enclosed cavity communicating with control fluid actuating means including a path extending through the one spindle, whereby a change in control fluid pressure shifts said one sleeve relative to the one spindle, axial movement thereof being transmitted to the actuator for shifting the valve closure member.

6. A valve in controlling the flow in a fluid transmission conduit in a subterranean well, comprising:

a valve closure member shiftable between open and closed positions;

a shiftable valve actuator having means for opening and closing the valve closure member upon axial movement of the valve actuator;

means for shifting the actuator;

a plurality of axially extending spindles circumferentially spaced around the valve actuator, the spindles being fixed relative to the movable valve actuator; and a plurality of sleeve members affixed to and circumferentially spaced around the valve actuator, each sleeve member receiving a spindle extending therethrough, the sleeve members being axially shiftable relative to the spindles;

whereby rotational alignment of the valve actuator during movement thereof is maintained by the cooperating fixed spindles and movable sleeve members.

7. A valve for controlling the flow in a fluid transmission conduit in a subterranean well, comprising:

a valve housing having a bore therethrough;

a valve closure member in the bore of the valve housing shiftable between open and closed positions;

a valve actuator axially shiftable relative to the housing and having means for opening and closing the valve closure member upon axial movement in the bore of the housing relative to the housing;

a spindle attached to the housing and extending in the bore of the housing axially between the housing and the valve actuator;

a sleeve disposed in the bore of the valve housing, concentrically around the spindle and axially shiftable relative thereto, and defining an enclosed cavity at one end of the sleeve adjacent the end of the spindle;

seal means for establishing sealing integrity between the spindle and the sleeve;

means for attaching said sleeve to said valve actuator; and control fluid actuating means including a path extending through the spindle and into the enclosed cavity between the end of the spindle and the one end of the sleeve; whereby a change in control fluid pressure shifts said sleeve relative to the spindle, axial movement of the sleeve being transmitted to the actuator for shifting the valve closure member.

8. The valve of claim 7 wherein the seal means are disposed adjacent the enclosed cavity at one end of the sleeve.

* * * * *